US009360786B2

(12) United States Patent
Ohta et al.

(10) Patent No.: US 9,360,786 B2
(45) Date of Patent: Jun. 7, 2016

(54) IMAGE FORMING APPARATUS FOR ADJUSTING WRITE START TIMING OF MULTICOLOR IMAGE

(71) Applicant: CANON KABUSHIKI KAISHA, Tokyo (JP)

(72) Inventors: Yuya Ohta, Toride (JP); Kuniyasu Kimura, Toride (JP); Takuya Hayakawa, Koshigaya (JP); Kiyoharu Kakomura, Nagareyama (JP); Seita Inoue, Kashiwa (JP); Naoka Omura, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/711,125

(22) Filed: May 13, 2015

(65) Prior Publication Data

US 2015/0338760 A1 Nov. 26, 2015

(30) Foreign Application Priority Data

May 23, 2014 (JP) ..... 2014-107482

(51) Int. Cl.
*G03G 15/01* (2006.01)
*G03G 15/00* (2006.01)

(52) U.S. Cl.
CPC ..... *G03G 15/0131* (2013.01); *G03G 15/5054* (2013.01)

(58) Field of Classification Search
CPC ..... G03G 15/5058; G03G 2215/00063; G03G 2215/0161; G03G 15/0131; G03G 15/01; G03G 2215/00067; G03G 2215/00059; G03G 15/5062; G03G 2215/00042; G03G 15/011; G03G 15/0189; G03G 15/043; G03G 15/502
See application file for complete search history.

(56) References Cited

U.S. PATENT DOCUMENTS 8,023,873 B2 9/2011 Nakatsu
2012/0229585 A1* 9/2012 Higashiyama ..... G03G 15/0194 347/116

FOREIGN PATENT DOCUMENTS

JP 2008-281833 A 11/2008
JP 2010-085422 A 4/2010

* cited by examiner

*Primary Examiner* — Roy Y Yi
(74) *Attorney, Agent, or Firm* — Fitzpatrick, Cella, Harper & Scinto

(57) ABSTRACT

A detection unit detects a color registration pattern formed on a transfer member. A first correction unit detects an amount of color misregistration, relative to a forming position of a color pattern having a reference color, of a forming position of a color pattern having another color and determines an offset value for adjusting a write start timing of the other color. A measuring unit measures the inclination of the transfer member. A second correction unit determines, according to the inclination, an offset value for adjusting the write start timing of each of the plurality of image forming units and for adjusting, relative to the write start timing of a reference color, the write start timing of another color. The reference color for the first correction unit is different from the reference color for the second correction unit.

16 Claims, 11 Drawing Sheets

IMAGE FORMING APPARATUS FOR ADJUSTING WRITE START TIMING OF MULTICOLOR IMAGE

BACKGROUND OF THE INVENTION

1. Field of the Invention

The present invention relates to an image forming apparatus that forms an image by using developer.

2. Description of the Related Art

Electrophotographic color image forming apparatuses form a multicolor image by layering toners each having a different color. Therefore, so-called color misregistration could occur when the layering positions of the toners having different colors are misaligned from their respective ideal positions. One approach to reduce the color misregistration and to improve the color registration (alignment) is to actually form a color pattern in each color on the intermediate transfer belt, measure the amount of color misregistration (misalignment) of each color, and then adjust the image write start timing with respect to each color according to the amount of color misregistration. The intermediate transfer belt is extended under tension between a plurality of rollers, and rotates in a predetermined running direction (sub-scanning direction). When the plurality of rollers are not in parallel or the outer diameter of any of the rollers is not uniform, the intermediate transfer belt diagonally moves or meanders, and causes another color misregistration problem. To solve this problem, Japanese Patent Laid-Open No. 2008-281833 proposes a technology of detecting the inclination of the intermediate transfer belt between adjacent photosensitive drums, and adjusting the write start positions on the photosensitive drums. Japanese Patent Laid-Open No. 2010-85422 discloses a technology of measuring and recording the inclination of the intermediate transfer belt at the time of detection of the amount of color misregistration by using color registration patterns, and adjusting the write start positions by comparing the recorded inclination with the inclination at the time of image formation.

According to Japanese Patent Laid-Open No. 2008-281833 and Japanese Patent Laid-Open No. 2010-85422, the influence of the diagonal movement and meandering of the intermediate transfer belt is reduced by changing the offset values used for adjusting the write start position according to the inclination of the intermediate transfer belt. In order to accurately determine an offset value used for adjusting a write start position, it is necessary to obtain the inclination of the transfer belt immediately before the transfer of the corresponding toner image. However, there are cases in which the calculation of the write start position cannot be completed in time with respect to the color that is used first for forming a toner image, from among the plurality of colors. For example, when toner images in yellow, magenta, cyan, and black are sequentially transferred to the intermediate transfer belt in this order, there is the possibility that the write start position of the yellow toner image cannot be accurately determined. In order to accurately determine the offset value used for adjusting the write start position, it is necessary to detect the inclination of the transfer belt immediately before the transfer of the toner image. However, in some cases, a long time gap occurs from the detection of the inclination of the intermediate transfer belt to the start of the writing of the toner image, because of the waiting time for the rasterization of image data, the waiting time for the preparatory operations by the paper discharge unit, etc. In such cases, a difference occurs between the calculated inclination and the actual inclination, and this difference degrades the accuracy of the color registration adjustment.

SUMMARY OF THE INVENTION

The present invention performs a color registration adjustment in an accurate manner without depending on the start timing of the image formation.

The present invention provides an image forming apparatus comprising the following elements. A plurality of image forming units is configured to form images each having a different color. A transfer unit is configured to perform primary transfer, to a transfer member, of images respectively generated by the plurality of image forming units. A detection unit is configured to detect a color pattern formed on the transfer member, the color pattern being used for detecting color misregistration. A first correction unit is configured to: control the plurality of image forming units so that the plurality of image forming units form, on the transfer member, a plurality of color patterns each having a different color; detect, by using the detection unit, the amount of color misregistration, relative to a forming position of a color pattern having a reference color among the plurality of color patterns, of a forming position of a color pattern having another color among the plurality of color patterns; and determine an offset value for adjusting an image write start timing of the other color according to the amount of color misregistration of the color pattern having the other color. A measuring unit is configured to measure the inclination of the transfer member. A second correction unit is configured to determine, according to the inclination measured by the measuring unit, an offset value for adjusting the image write start timing of each of the plurality of image forming units and for adjusting, relative to the write start timing of a reference color, the write start timing of another color. The reference color for the first correction unit is different from the reference color for the second correction unit.

Further features of the present invention will become apparent from the following description of exemplary embodiments (with reference to the attached drawings).

DESCRIPTION OF THE EMBODIMENTS

The following describes an embodiment for implementing the present invention, with reference to the drawings. It should be noted that the following embodiment is not intended to limit the invention recited in the claims, and all combinations of features described in the embodiment are not necessarily mandatory as solutions provided by the invention.

Figure 1:
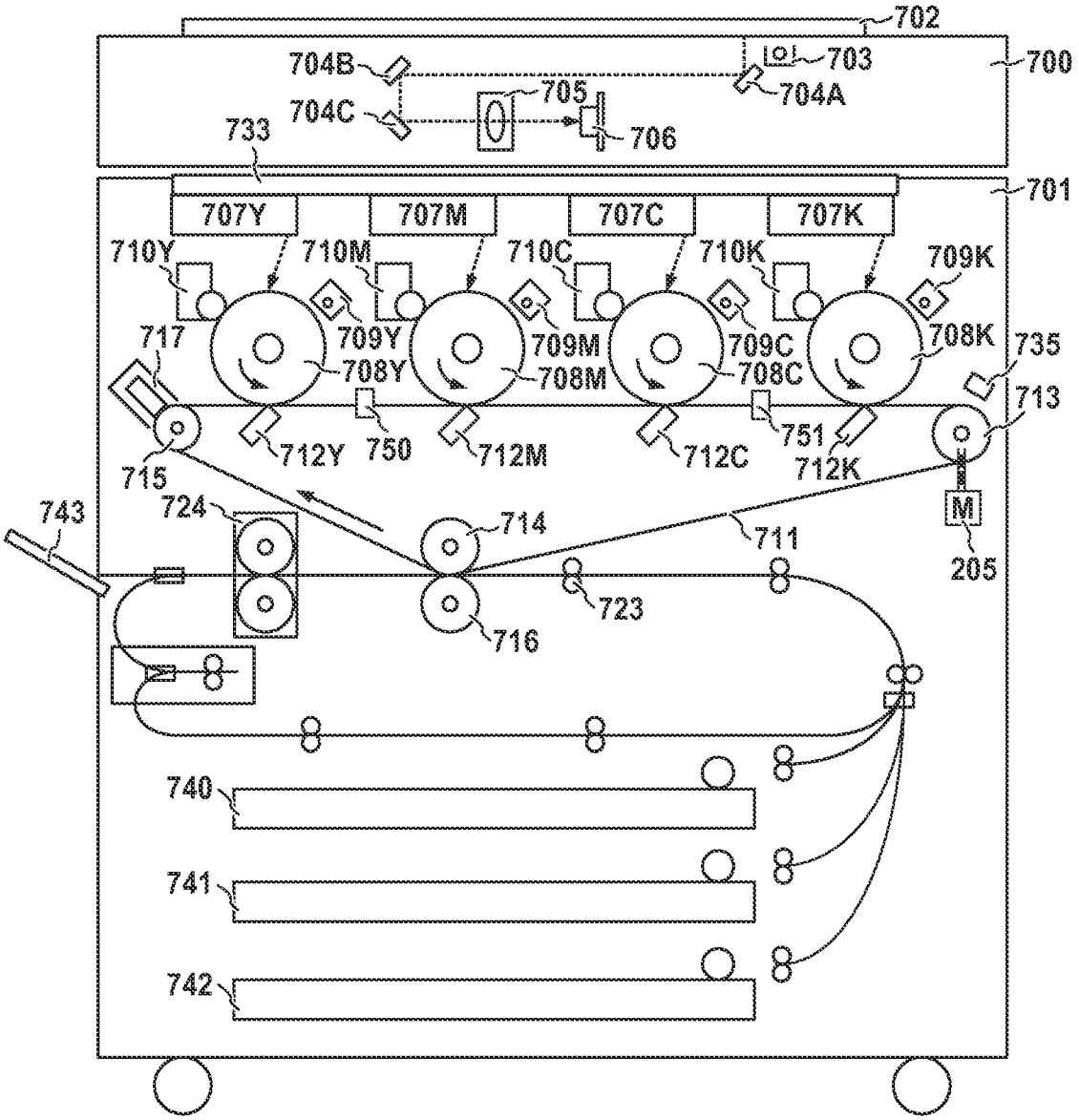
FIG. 1 is a diagram showing an example of a configuration of an image forming apparatus.

FIG. 1 is a diagram showing an example of a configuration of an image forming apparatus according to one embodiment. The image forming apparatus according to the present embodiment forms a multicolor image by using yellow (Y), magenta (M), cyan (C), and black (K) developers (toners). The image forming apparatus includes an image reading unit 700 and an image forming unit 701. The image forming unit 701 has four image forming stations corresponding to the colors Y, M, C and K, which are provided with photosensitive members 708Y, 708M, 708C and 708K in one-to-one correspondence. In other words, a first image forming station has a photosensitive member 708Y, a second image forming station has a photosensitive member 708M, a third image forming station has a photosensitive member 708C, and a fourth image forming station has a photosensitive member 708K. In the present Specification and Drawings, the suffix Y, M, C, or K included in the reference sign assigned to each unit indicates the color, Y, M, C, or K, of the image formed by the corresponding unit. Note that the number of toner colors may be five or more.

The image reading unit 700 forms an image of a document 702 on a color sensor 706 via an illumination lamp 703, a group of mirrors 704A, 704B, and 704C, and a lens 705. The color sensor 706 reads color image information of the document for each color-separated light of the colors blue (B), green (G), and red (R) for example, and transforms the color image information into electrical image signals. These signals are transmitted to a calculation unit 733. The calculation unit 733 performs color conversion processing based on the intensity levels of the color-separated image signals corresponding to the colors R, G, and B, thereby generating image data corresponding to the colors Y, M, C, and K. The calculation unit 733 may transmit or receive external input data from a telephone line or a network via an external interface. When received data is page description language (PDL) data, color image data may be obtained by a PDL processing unit expanding the data into image information.

In the image forming unit 701, laser scanner units 707Y, 707M, 707C, and 707K, which are provided in one-to-one correspondence with the toners having different colors, transform the color image data from the image reading unit 700 into optical signals, and perform optical writing according to the document image. Thus, an electrostatic latent image is formed on the photosensitive members 708Y, 708M, 708C, and 708K. The photosensitive members 708Y, 708M, 708C, and 708K rotate counterclockwise as indicated by the arrow. Charger units 709Y, 709M, 709C, and 709K, and developing units 710Y, 710M, 710C, and 710K are disposed around the photosensitive members 708Y, 708M, 708C, and 708K, respectively. The intermediate transfer belt 711 serves as an image carrier as well as a transfer member. The intermediate transfer belt 711 is extended under tension between primary transfer blades 712Y, 712M, 712C, and 712K, a drive roller 715, a steering roller 713, and a driven roller 714. Each of the developing units 710Y, 710M, 710C, and 710K in the image creation systems described above is made up from, for example, a developing sleeve that rotates while bringing a brush of developer into contact with the surface of the photosensitive member in order to develop the electrostatic latent image, and a developing paddle that rotates in order to pick up and stir the developer.

A secondary transfer roller 716 is disposed at a position opposing the driven roller 714 of the intermediate transfer belt 711, and has a distance control mechanism by which the secondary transfer roller 716 can be moved apart from or brought in contact with the intermediate transfer belt 711.

In addition, a belt cleaning unit 717 is provided on the surface of the intermediate transfer belt 711, at a predetermined position opposing the drive roller 715. The belt cleaning unit 717 is separated from the belt surface during the period from the start of a printing to the end of the transfer, to the belt, of the trailing edge of the image having the last color. When the transfer is completed, the belt cleaning unit 717 is brought into contact with the belt surface by a distance control mechanism (not shown in the drawing), and performs cleaning.

In a color printer unit, image formation using the color yellow is started first. After that, image formation using the color magenta is started with a delay corresponding to the distance between the photosensitive member 708Y and the photosensitive member 708M in consideration of the rotation speed of the intermediate transfer belt 711. Subsequently, image formation using the color cyan is started with a delay corresponding to the distance between the photosensitive member 708M and the photosensitive member 708C in consideration of the rotation speed of the intermediate transfer belt 711. Subsequently, image formation using the color black is started with a delay corresponding to the distance between the photosensitive member 708C and the photosensitive member 708K in consideration of the rotation speed of the intermediate transfer belt 711.

The calculation unit 733 reads image data stored in an image memory 603. Based on this image data, the laser scanner units 707Y, 707M, 707C, and 707K perform optical writing using a laser beam, onto the photosensitive members 708Y, 708M, 708C, and 708K, which have been uniformly charged by the charger units 709Y, 709M, 709C, and 709K with predetermined timing. The following provides a description of image formation with the drum for yellow as a representative of the four drums. When laser exposure for the photosensitive member 708Y is started, the developing sleeve of the developing unit 710Y starts rotating and applying a developing bias, in order to realize the development starting from the leading edge of the Y-color latent image. Since then, the development operation is continued for the development of the Y-color latent image, and the development operation is stopped when the trailing edge of the latent image passes through the developing position for Y. A yellow toner image formed on the photosensitive member 708Y is transferred to the intermediate transfer belt 711 by the primary transfer blade 712Y, and is retained on the intermediate transfer belt 711.

One paper cassette is selected from among paper cassettes 740, 741, and 742, and a sheet of paper fed from the selected tray is conveyed via a registration roller 723. The paper feed timing and starting timing of the laser exposure scanning on the photosensitive drum are determined according to a page synchronization signal (ITOP signal) generated by the calculation unit 733. Accordingly, the paper feed timing and the image formation timing are brought into synchronization, and the color toner images developed on the photosensitive members 708Y, 708M, 708C, and 708K are layered on the intermediate transfer belt 711, and are transferred to the sheet of paper by the secondary transfer roller 716. Sheets of paper to which toner images have been transferred are separated and conveyed, and undergo the fixing performed by a fixing device 724. The fixing device 724 includes therein a fixing roller, which has a built-in halogen heater, and a pressure roller, and fixes a toner image on a sheet of paper by application of heat and pressure. After the fixing, a sheet of paper with the fixed toner image is ejected onto a catch tray 743.

A belt edge sensor 751 for detecting meandering of the intermediate transfer belt 711, and a belt edge sensor 750 are disposed at a side edge of the intermediate transfer belt 711. The belt edge sensor 751 detects meandering of the belt, and a steering motor 205 controls the steering roller 713 so as to regulate the meandering of the intermediate transfer belt 711 to be within a predetermined range. Also, the inclination of the intermediate transfer belt 711 is detected by using the two sensors, namely the belt edge sensor 750 and the belt edge sensor 751.

Figure 2:
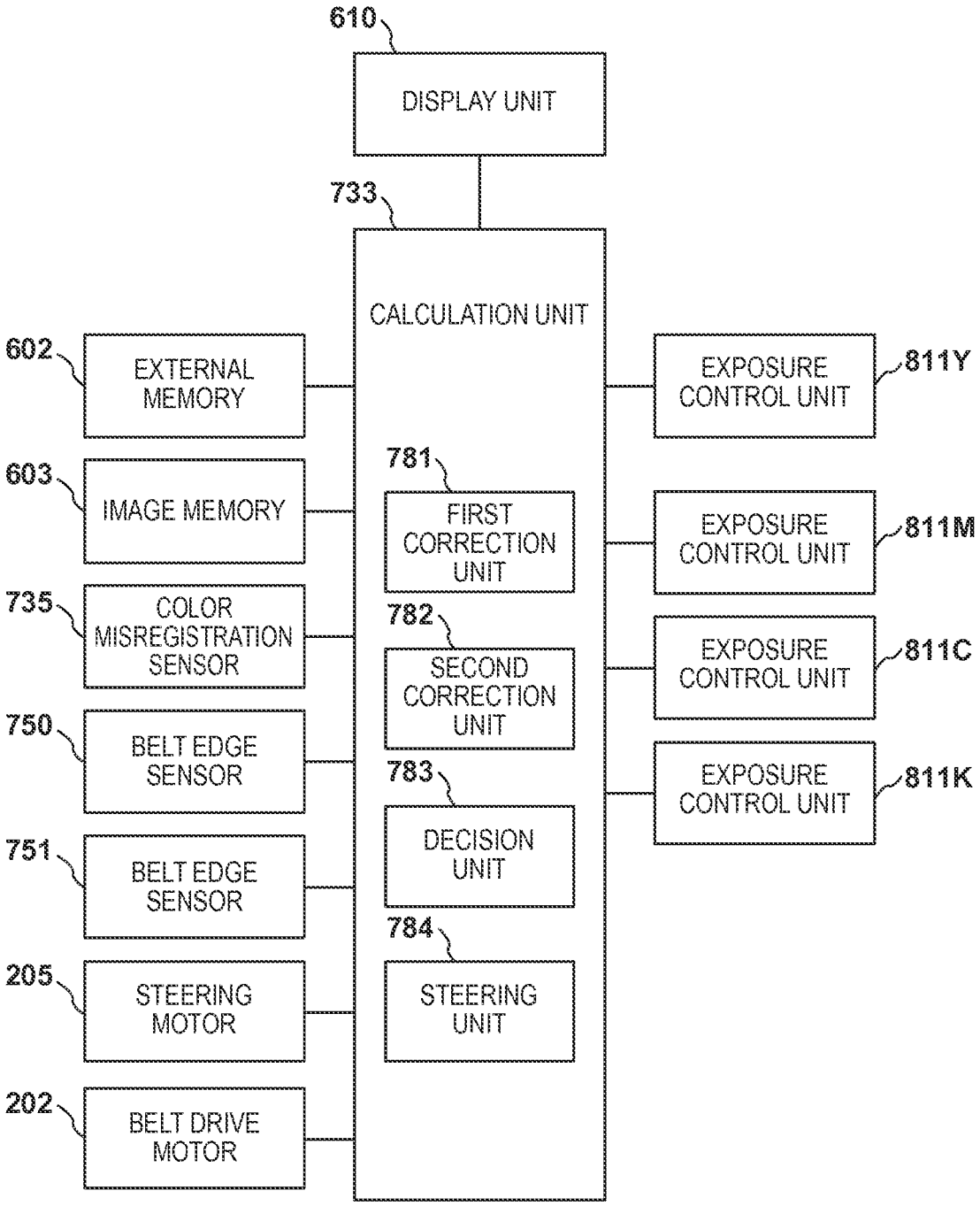
FIG. 2 is a block diagram showing the relationship between a calculation unit and each load.

FIG. 2 is a block diagram showing the relationship among the calculation unit 733, exposure control units, and various sorts of motors and sensors. The calculation unit 733 stores images that have undergone various sorts of processing, such as PDL expansion, into the image memory 603. With predetermined timing, exposure control units 811Y, 811M, 811C, and 811K make a request to the calculation unit 733 for an image. The calculation unit 733 reads an image from the image memory 603, performs image processing by using an external memory 602, etc., and transmits image signals corresponding to the respective colors to the exposure control units 811Y, 811M, 811C, and 811K. Each of the exposure control units 811Y, 811M, 811C and 811K transforms the image signal into laser drive pulses, and controls a laser beam to form a desired image. The calculation unit 733 also drives various sorts of motors and sensors, with predetermined timing. The motors and sensors are used for image formation and conveyance of paper sheets.

The calculation unit 733 has various functions. A first correction unit 781 causes the image forming unit 701 to form a plurality of color patterns each having a different color, which are used for color misregistration detection (color registration adjustment/color alignment). Furthermore, using a color misregistration sensor 735, the first correction unit 781 detects the amount of the misregistration (misalignment), relative to the forming position of the color pattern having a reference color among the plurality of color patterns, of the amount of the misregistration of the forming position of a color pattern having another color among the plurality of color patterns. The first correction unit 781 determines the offset value (adjustment value) used for adjusting the image write start timing of the other color, according to the amount of the misregistration of the color pattern having the other color. The calculation unit 733, the belt edge sensor 750, and the belt edge sensor 751 serve as a measuring unit for measuring the inclination of the intermediate transfer belt 711. This inclination is the inclination from the ideal direction. The ideal direction is the image conveyance direction in design of the intermediate transfer belt 711. A second correction unit 782 determines the offset value used for adjusting the image write start timing of each of the plurality of image forming stations according to the measured inclination. The offset value is, in other words, a value for adjusting, relative to the write start timing of the reference color, the write start timing of another color. A decision unit 783 decides whether or not the offset values determined by the second correction unit 782 are greater than a threshold value. A steering unit 784 drives the steering motor 205 according to the result of the detection by the belt edge sensor 751, thereby adjusting the position of the side edge of the intermediate transfer belt 711.

Figure 3:
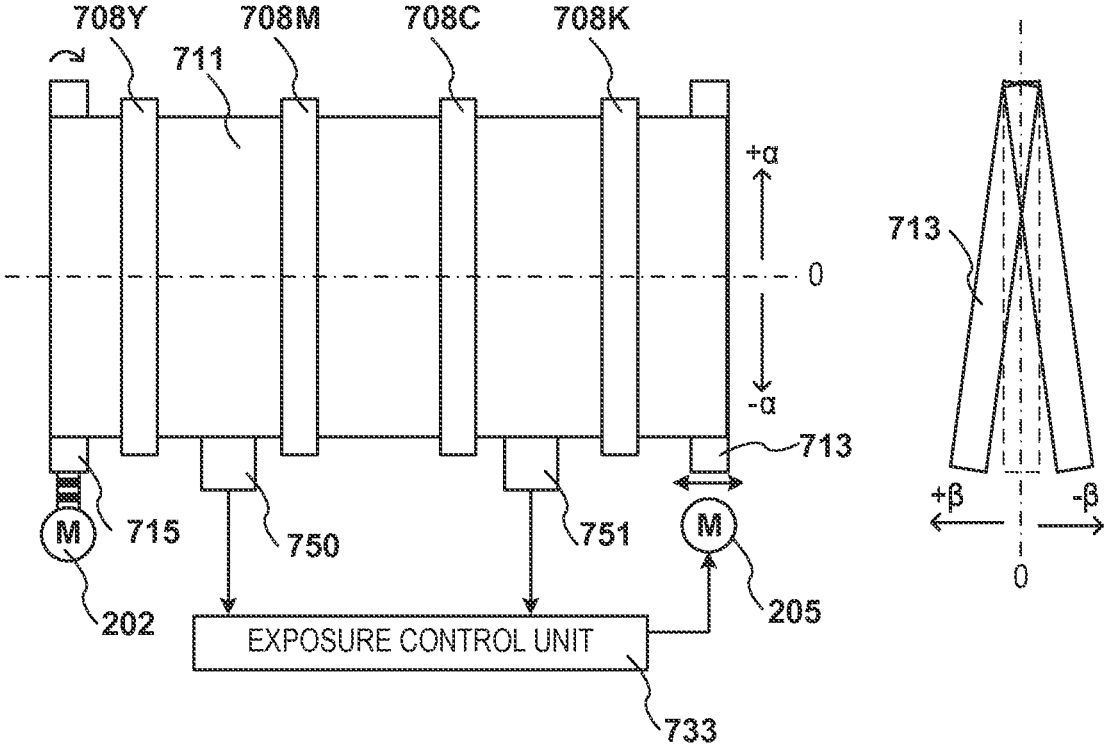
FIG. 3 is a diagram illustrating belt deviation control and color registration adjustment.

FIG. 3 is a simplified diagram illustrating belt deviation control and color registration adjustment by correcting color misregistration caused by meandering of the belt. The intermediate transfer belt 711 rotates by being driven by the drive roller 715 that rotates clockwise. The drive roller 715 is driven by a belt drive motor 202. The steering roller 713 is controlled by the steering motor 205. The following describes the steering control. The calculation unit 733 controls the steering motor 205 according to the output from the belt edge sensor 751. In this description, it is assumed that the intermediate transfer belt 711 moves toward the $+\alpha$ direction from a predetermined reference position.

Based on the result of the detection by the belt edge sensor 751, the calculation unit 733 recognizes that the intermediate transfer belt 711 has moved toward the $+\alpha$ direction from the reference position. The calculation unit 733 drives the steering motor 205 to move the steering roller 713 toward the $+\beta$ direction, thereby moving the intermediate transfer belt 711 toward the $-\alpha$ direction. When detecting that the intermediate transfer belt 711 has moved toward the $-\alpha$ direction from the reference position, the calculation unit 733 drives the steering motor 205 to move the steering roller 713 toward the $-\beta$ direction, thereby moving the intermediate transfer belt 711 toward the $+\alpha$ direction. By this steering control, the intermediate transfer belt 711 is controlled so as not to deviate from the reference position and reach a side edge of the steering roller 713.

Next, a description is given to the belt inclination detection. The belt edge sensor 751 has two functions, namely the function of belt steering control and the function of the belt inclination detection. The belt edge sensor 750 may be used only for detecting the inclination of the belt. A belt inclination calculation unit included in the second correction unit 782 detects the inclination of the belt in the main scanning direction based on two detection results, namely the detection result from the belt edge sensor 750 and the detection result from the belt edge sensor 751.

Figure 4A:
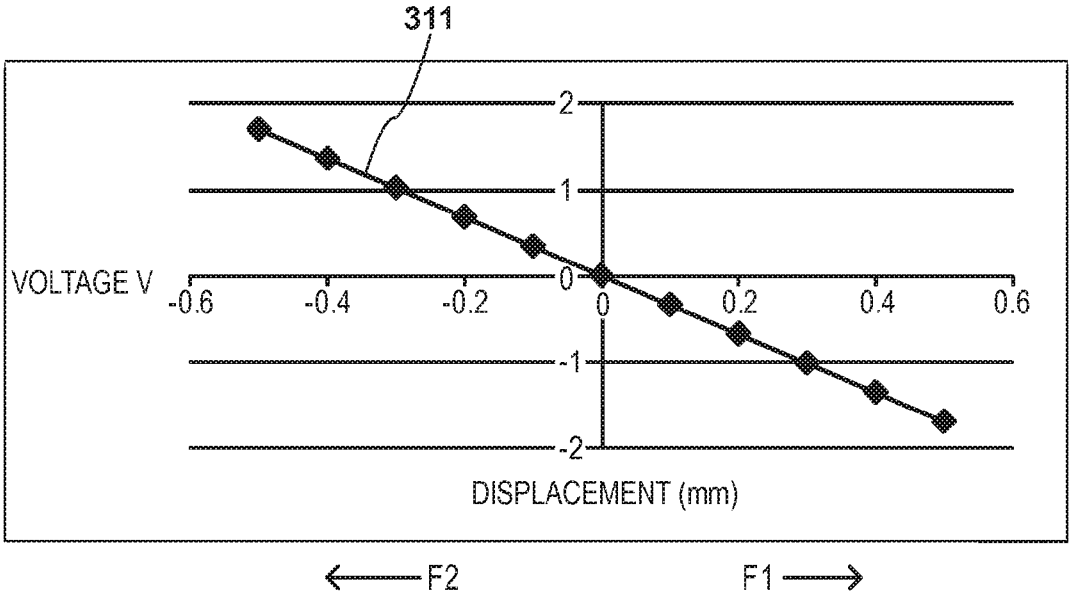
FIG. 4A is a diagram showing the relationship between a displacement of a position of an intermediate transfer belt and a voltage output by belt edge sensors.
Figure 4B:
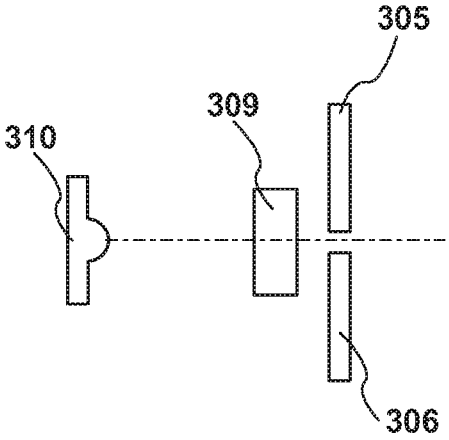
FIGS. 4B and 4C are diagrams illustrating the belt edge sensors.
Figure 4C:
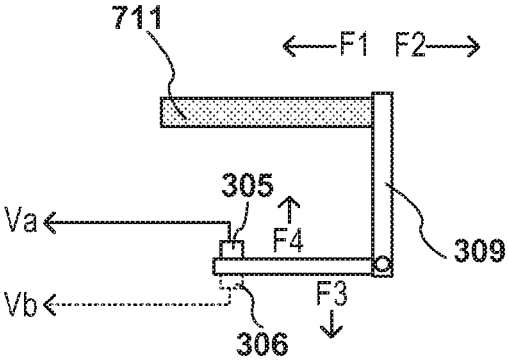

FIGS. 4A to 4C are diagrams illustrating the operation of the belt edge sensors 750 and 751. Among these figures, FIG. 4A shows the relationship 311 between the displacement of the position of the intermediate transfer belt 711 and the voltage output by the belt edge sensors 750 and 751. As shown in FIG. 4B, each of the belt edge sensors 750 and 751 has photosensors 305 and 306. These photosensors have the same characteristics in performance of photoelectric conversion. The photosensors 305 and 306 detect light emitted by a light-emitting diode (LED 310). A portion of the light emitted by the LED 310 is blocked by a flag 309 disposed between the LED 310 and the photosensors 305 and 306. As shown in FIG. 4C, when the intermediate transfer belt 711 moves in the main scanning direction as indicated by the arrow Fl, the flag 309 moves in the direction indicated by the arrow F3. Consequently, the amount of a portion of the light emitted from the LED 310, the portion being guided to the photosensor 306, is reduced by being blocked by the flag 309. On the other hand, the amount of the light guided to the photosensor 305 increases. When the intermediate transfer belt 711 moves in the direction indicated by the arrow F2, the flag 309 moves in the direction indicated by the arrow F4.

Consequently, the amount of the light guided to the photosensor 305 is reduced by being blocked by the flag 309, and in contrast the amount of light guided to the photosensor 306 increases.

In FIG. 4A, the vertical axis represents a sensor voltage obtained by dividing the output voltage Vb from the photosensor 306 by the output voltage Va from the photosensor 305. The horizontal axis represents the displacement of the side edge of the intermediate transfer belt 711 from a reference position. The sensor voltage is proportional to the position of the side edge of the intermediate transfer belt 711. Therefore, the calculation unit 733 can obtain the position of the side edge of the intermediate transfer belt 711 from the sensor voltage.

Next, a description is given to the color registration adjustment. The color registration adjustment is processing of forming color patterns for the color registration adjustment on the intermediate transfer belt 711, thereby detecting the amount of color misregistration relative to the reference color for each of the other three colors, and then adjusting the write start position (write start timing) of each of the three colors so as to reduce the amount of color misregistration. This color registration adjustment can be divided into two types of processing, namely processing for correcting the color misregistration caused by distortion of the entire framework of the image forming apparatus, distortion of the shape of the laser scanner unit, etc., and processing for correcting the color misregistration caused by the meandering of the intermediate transfer belt 711.

The color registration adjustment using the color registration patterns takes into consideration the distortion in the entire framework, and accordingly determines, from among the four colors of the image forming units, the color of the image forming unit located in the middle to be the reference color. In the present embodiment, magenta is determined to be the reference color from among yellow, magenta, cyan, and black. In other words, relative to the forming position of the magenta toner image as the reference position, the forming positions of the toner images having the other three colors (yellow, cyan, and black) are adjusted to be their respective ideal positions. In other words, the write start timings of the toner images having the other three colors are adjusted.

While the image forming unit 701 is in the standby state or is executing a job, the calculation unit 733 forms color registration patterns on the photosensitive members 708Y, 708M, 708C, and 708K, and performs primary transfer of the color registration patterns to the intermediate transfer belt 711. The calculation unit 733 reads the color registration patterns by using the color misregistration sensor 735 disposed to oppose the intermediate transfer belt 711, and obtains the positional relationship among the colors yellow, magenta, cyan, and black. Based on the positional relationship among the colors, the calculation unit 733 calculates the amount of the misregistration in the main scanning direction and the amount of the misregistration in the sub-scanning direction for each of the colors yellow, cyan, and black relative to the color magenta, and calculates offset values used for correcting the misregistration in the main scanning direction and offset values used for correcting the misregistration in the sub-scanning direction.

Figure 5A:
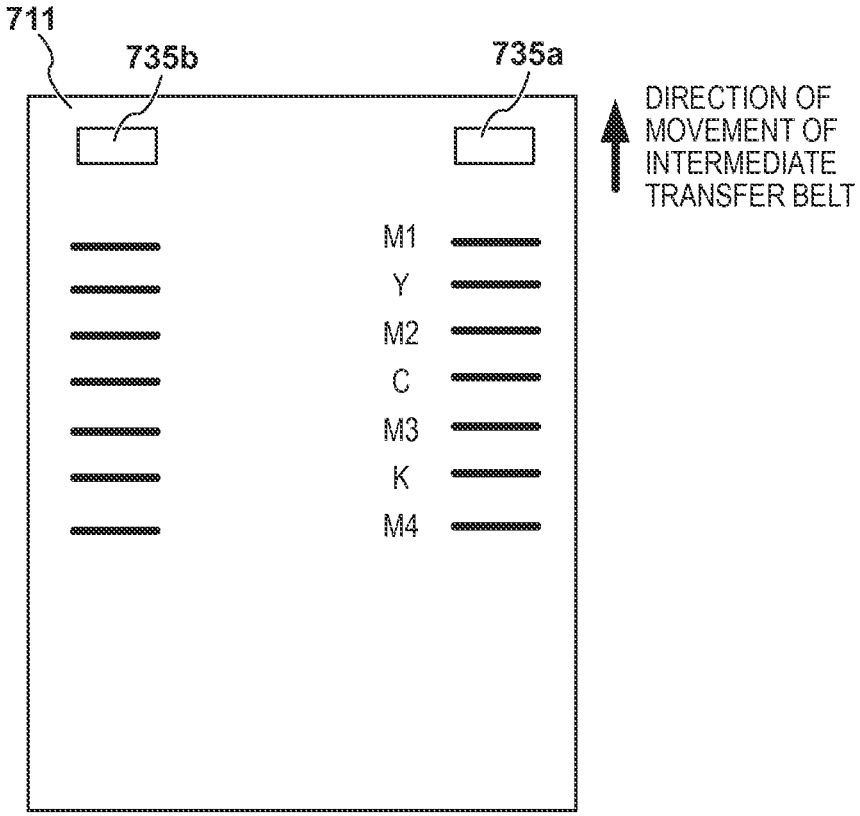
FIGS. 5A and 5B are conceptual diagrams showing color misregistration detection with use of color patterns.
Figure 5B:
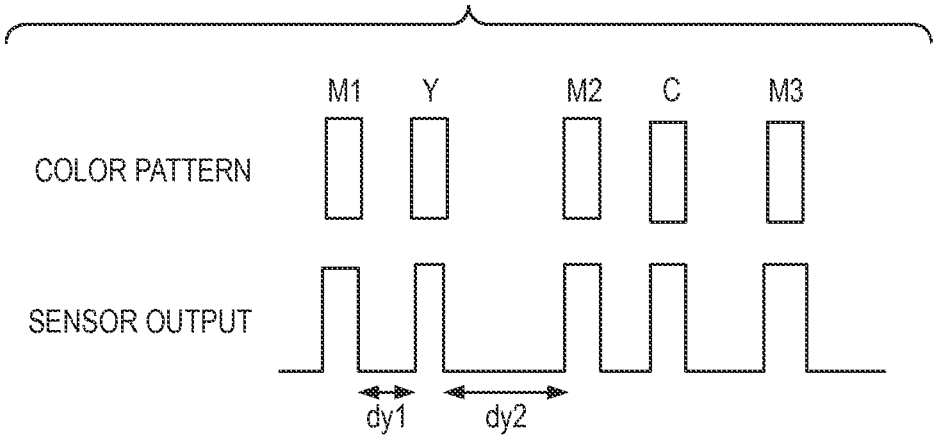

Assume that the color registration patterns are formed on the intermediate transfer belt 711 in the manner shown in FIG. 5A. The color misregistration sensor 735 may include two sensors, such as color misregistration sensors 735*a*, 735*b*. The output from the color misregistration sensor 735*a* has a waveform as shown in FIG. 5B. Here, assume that dy1 denotes the distance between the magenta pattern M1 and the yellow pattern Y, and dy2 denotes the distance between the yellow pattern Y and the magenta pattern M2. The amount Δdmy of the misregistration of yellow relative to magenta is expressed by the following equation.

$$\Delta dmy = dy2 - dy1 \quad (1)$$

The calculation unit 733 calculates the amount of the misregistration of cyan and black as well in the same manner. The calculation unit 733 also determines the offset values so as to reduce the amount of the misregistration of each color to zero. These offset values are set to the exposure control units 811Y, 811M, 811C, and 811K, and thus the color misregistration of yellow, cyan, and black will be corrected.

Figure 6A:
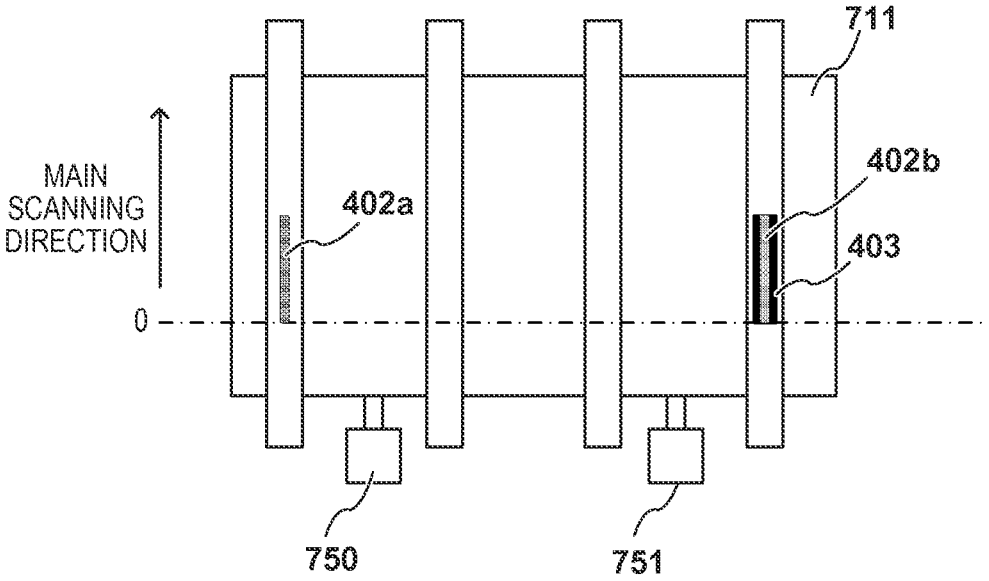
FIGS. 6A and 6B are diagrams illustrating color registration adjustment by correcting color misregistration caused by belt inclination.
Figure 6B:
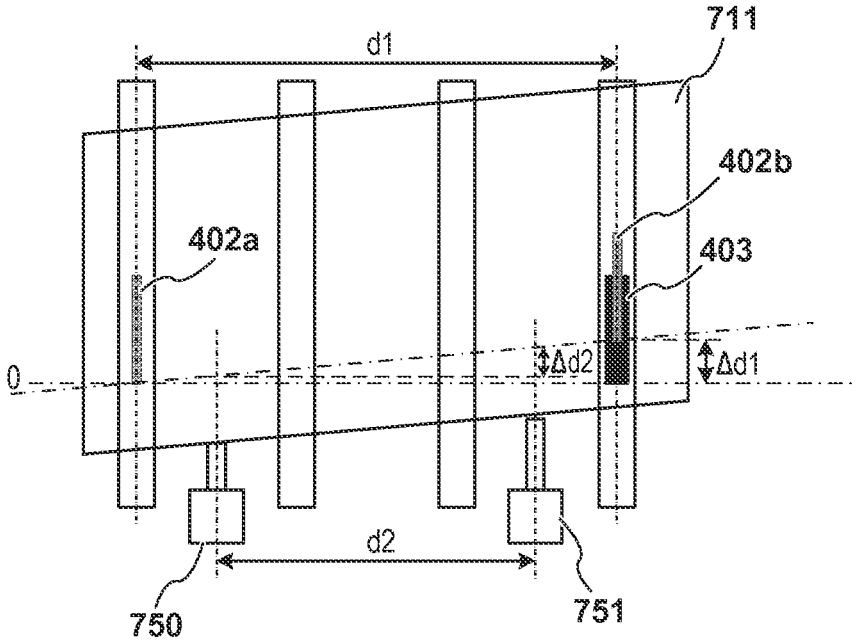

Next, a description is given to the color registration adjustment by correcting the color misregistration caused by meandering of the belt. FIG. 6A and FIG. 6B are schematic diagrams illustrating the color registration adjustment by correcting the color misregistration caused by meandering of the intermediate transfer belt 711. FIG. 6A shows that the intermediate transfer belt 711 is not diagonally moving, and FIG. 6B shows that the intermediate transfer belt 711 is diagonally moving. 402*a* indicates a yellow toner image located at the primary transfer position for yellow. 402*b*indicates the yellow toner image located at the primary transfer position for black. 403 indicates a black toner image located at the primary transfer position for black. The yellow toner image 402*a* on the photosensitive member 708Y for yellow is transferred to the intermediate transfer belt 711 at its primary transfer position, and this yellow toner image 402*a* reaches the primary transfer position for the black color and overlaps the black toner image 403. The yellow toner image 402*a* moved to the primary transfer position for the black color is referred to as yellow toner image 402*b*. As shown in FIG. 6A, if the intermediate transfer belt 711 does not meander or diagonally move, the yellow toner image 402*b* and the black toner image 403 overlap each other without color misregistration. In other words, a color image is realized without misregistration in the main scanning direction of the colors yellow and black.

If the intermediate transfer belt 711 is inclined as shown in FIG. 6B, the yellow toner image 402*b* and the black toner image 403 are transferred with misregistration in the main scanning direction, and thus color misregistration occurs. Here, assume that d1 (mm) denotes the distance between the photosensitive member 708Y for yellow and the photosensitive member 708K for black. Also assume that, at the primary transfer position of the photosensitive member 708K for black, the intermediate transfer belt 711 has deviated by Δd1 (mm) relative to the primary transfer position of the photosensitive member 708Y for yellow. The inclination g of the intermediate transfer belt 711 can be obtained by the following equation.

$$g = \Delta d1\ (\mathrm{mm}) / d1 (\mathrm{mm}) \quad (2)$$

As shown in FIG. 6B, the amount of the deviation of the intermediate transfer belt 711 detected by the belt edge sensor 750 and the belt edge sensor 751 is Δd2. The distance between the sensors is d2 (mm). Therefore, the inclination g' of the intermediate transfer belt 711 detected by the sensors is expressed by the following equation.

$$g' = \Delta d2\ (\mathrm{mm}) / d2\ (\mathrm{mm}) \quad (3)$$

Since the inclinations of the belt should be the same, g=g' is satisfied.

$$\Delta d1\ (\mathrm{mm}) / d1\ (\mathrm{mm}) = \Delta d2\ (\mathrm{mm}) / d2\ (\mathrm{mm}) \quad (4)$$

Therefore, the amount Δd1 of the misregistration in the main scanning direction of yellow relative to black, which is caused by inclination of the intermediate transfer belt 711, can be obtained by the following equation.

$$\Delta d1 = (\Delta d2 \times d1) / d2\ (\mathrm{mm}) \quad (5)$$

Thus, the amount Δd1 of the misregistration can be obtained by detecting the inclination by using the belt edge sensor 750 and the belt edge sensor 751. The calculation unit 733 calculates offset value ta for adjusting the write start timing by dividing the misregistration amount Δd1 by the scanning speed v of the laser beam on the photosensitive member 708Y for yellow, and sets the offset value ta to the exposure control unit 811Y. The exposure control unit 811Y corrects the write start timing of yellow to be earlier by the offset value ta, which has been set by the calculation unit 733.

Next, a description is given to the color registration adjustment by correcting the color misregistration caused by meandering of the belt, with respect to each color. Here, assume that the transfer position of the yellow toner image, which is formed first, is the reference position.

Figure 7A:
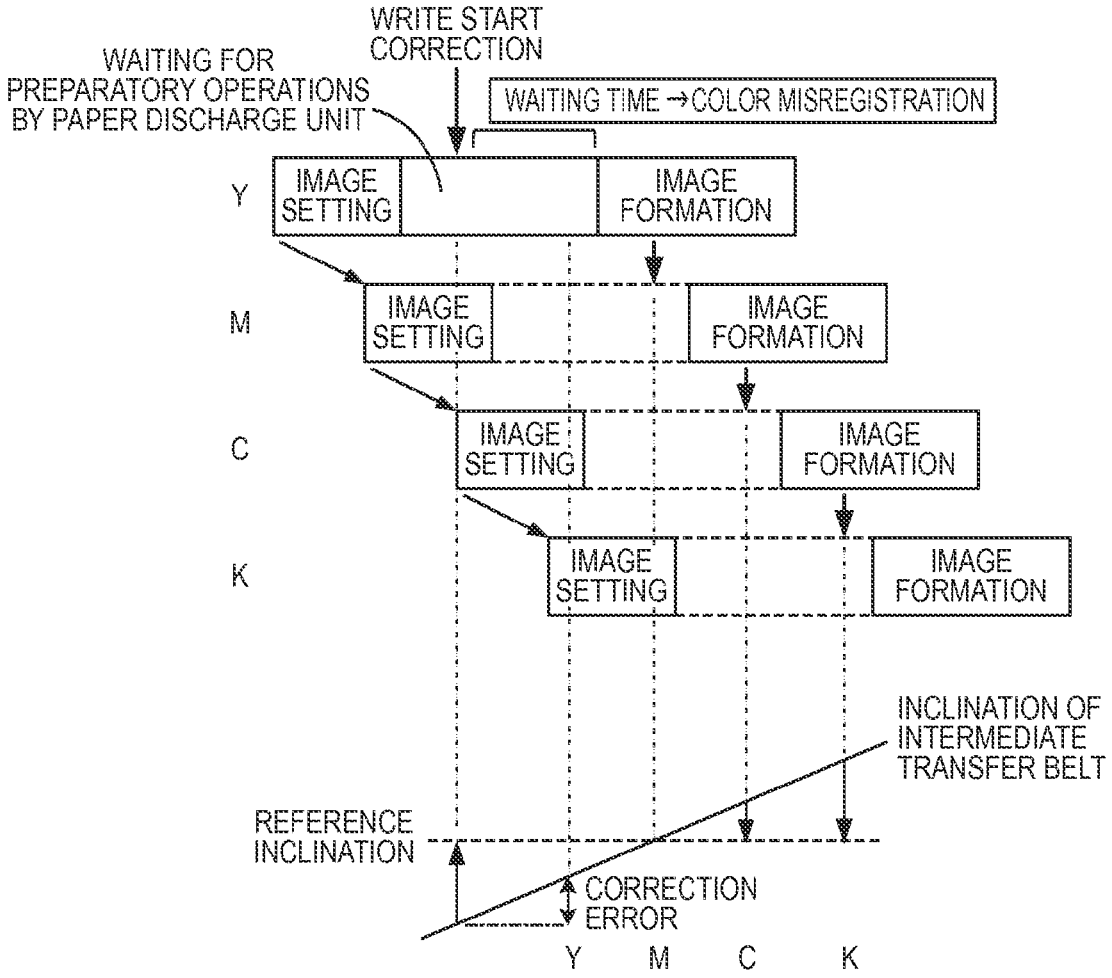
FIGS. 7A and 7B are conceptual diagrams illustrating color registration adjustment by correcting color misregistration caused by belt inclination.
Figure 7B:
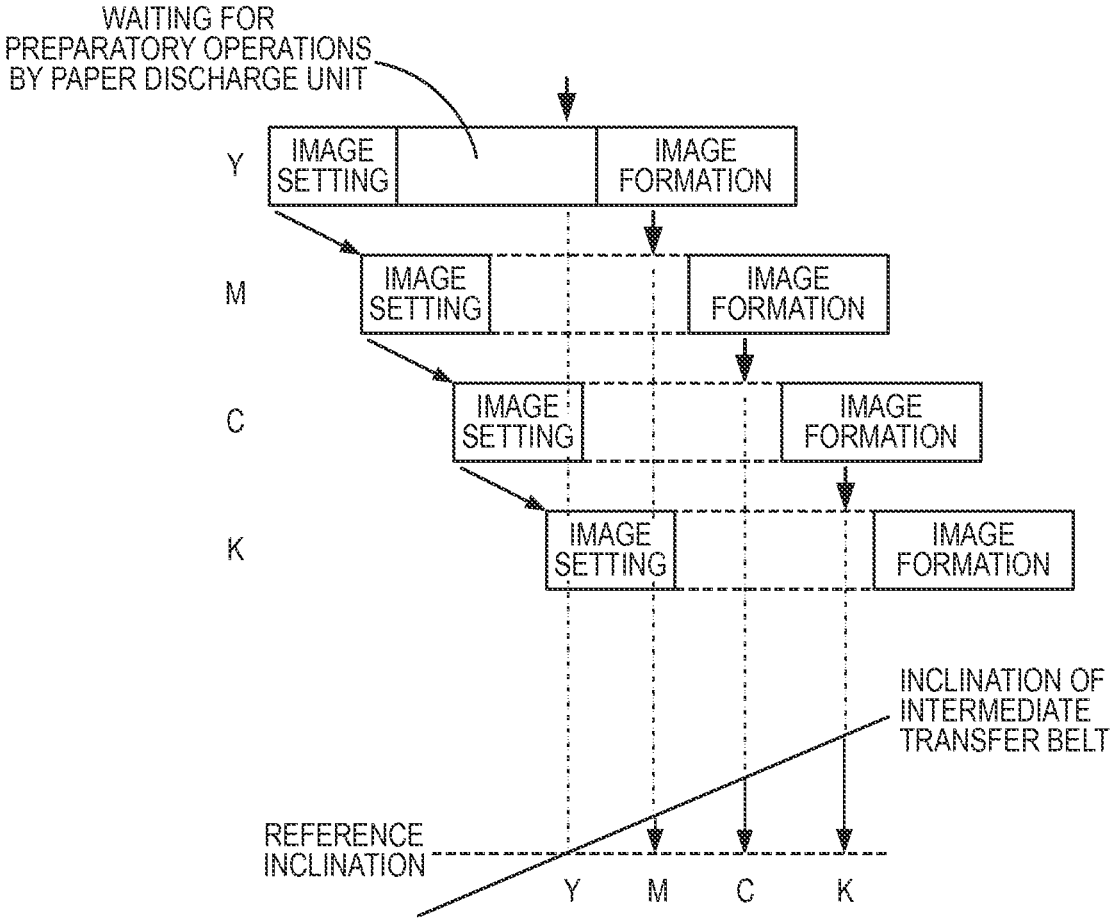

As shown in FIG. 7A, if the position of magenta is determined as the reference position for the inclination detection in the same manner as in the color misregistration detection using the color registration patterns, the write start position of the yellow toner image needs to be changed. In this case, the start timing of the image formation might vary due to waiting time for the preparatory operations by the paper discharge unit, etc., and accordingly, it cannot be possible to accurately correct the write start position of yellow. Considering this, in the present embodiment, the position of yellow is determined to be the reference position for the inclination detection, as shown in FIG. 7B. With this configuration, the inclination of the intermediate transfer belt 711 is detected immediately after the start of the image formation, which allows for accurate color registration adjustment not depending on the start timing of the image formation.

The amount of the misregistration in the main scanning direction of each color can be obtained by using the equation (5).

$$\Delta d1m=(\Delta d2\times d1m)/d2 \text{ (mm)}$$

$$\Delta d1c=(\Delta d2\times d1c)/d2 \text{ (mm)}$$

$$\Delta d1k=(\Delta d2\times d1k)/d2 \text{ (mm)}$$

d1*m* denotes the distance between the photosensitive member 708Y for yellow and the photosensitive member 708M for magenta. d1*c* denotes the distance between the photosensitive member 708Y for yellow and the photosensitive member 708C for cyan. d1*k* denotes the distance between the photosensitive member 708Y for yellow and the photosensitive member 708K for black. Δd1*m* denotes the amount of the misregistration in the main scanning direction of magenta relative to yellow. Δd1*c* denotes the amount of the misregistration in the main scanning direction of cyan relative to yellow. Δd1*k* denotes the amount of the misregistration in the main scanning direction of black relative to yellow. The calculation unit 733 shifts the write start timings of the magenta, cyan, and black toner images by time (offset value) corresponding to Δd1*m*, Δd1*c*, and Δd1*k* so as to reduce these misregistration amounts to zero. Consequently, the color misregistration can be reduced even if the intermediate transfer belt 711 rotating is inclined relative to the ideal direction. In addition, since this color registration adjustment does not depend on the timing of the image formation, the color misregistration can be reduced appropriately with respect to even the color of the toner image that is formed first, from among a plurality of colors.

Figure 8A:
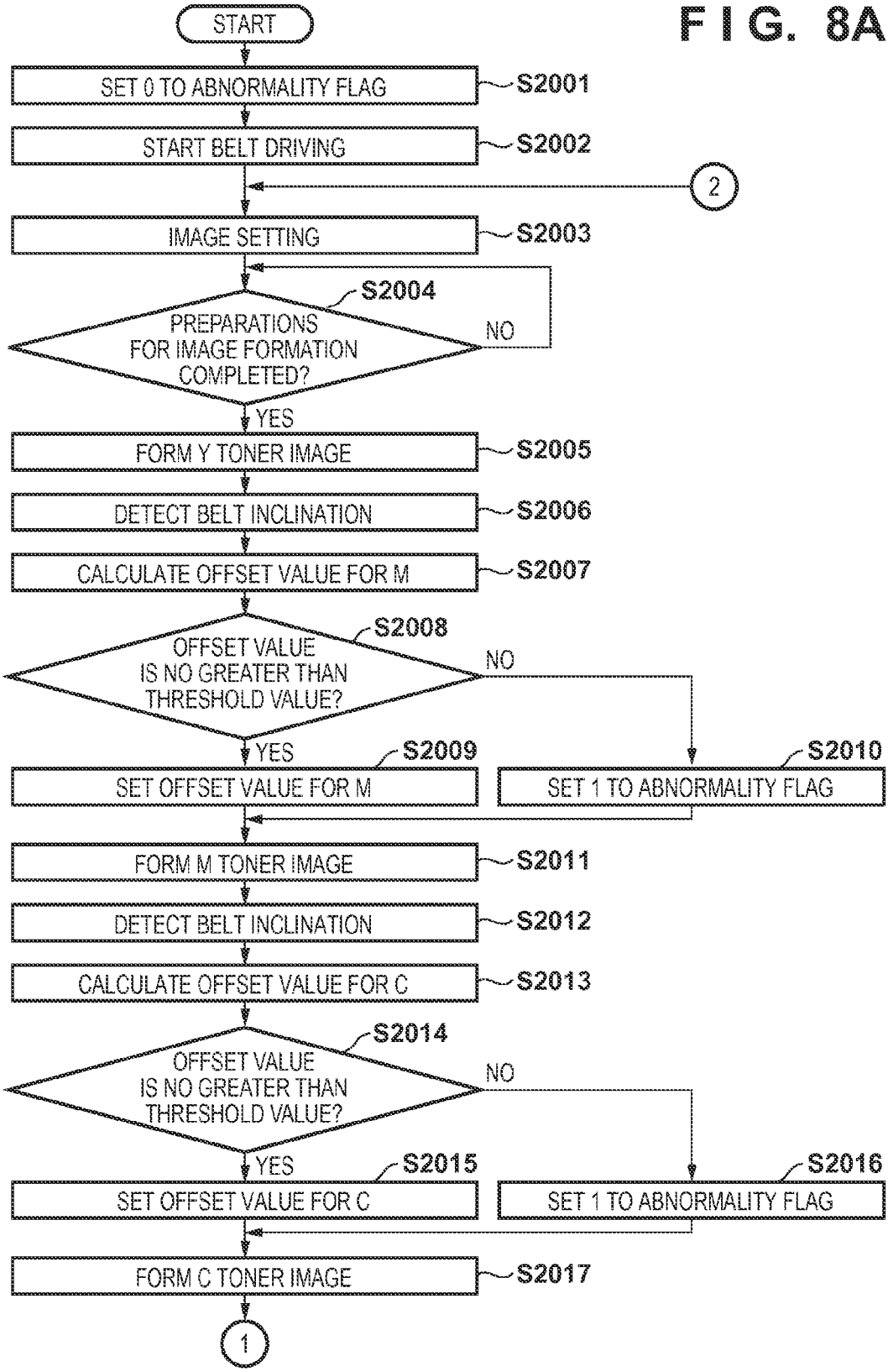
FIGS. 8A and 8B are flowcharts for color registration adjustment by correcting color misregistration caused by belt inclination.
Figure 8B:
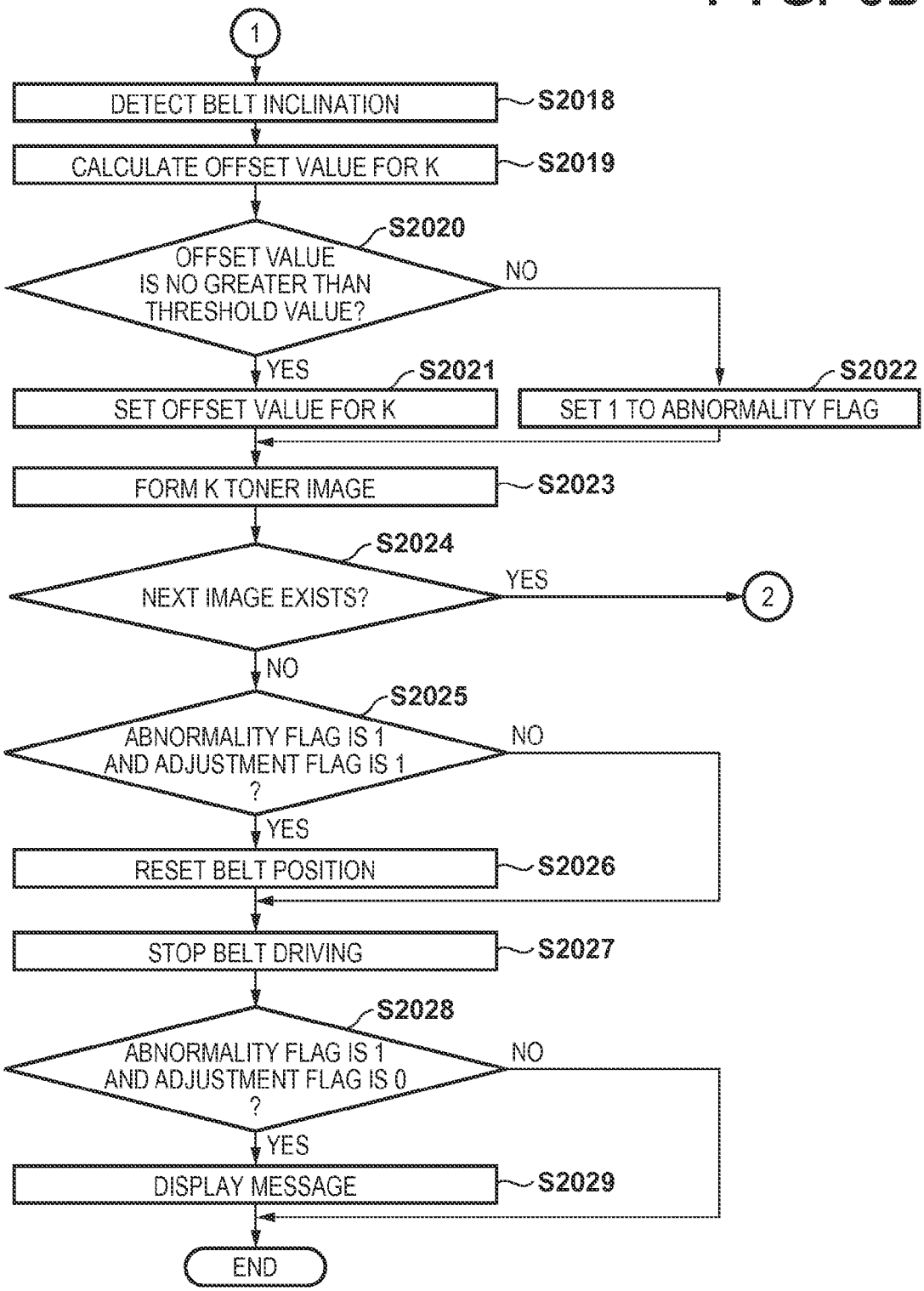

FIGS. 8A and 8B are flowcharts of operation for the correction of the color misregistration caused by meandering of the belt. When a job is started, the calculation unit 733 advances to S2001. At S2001, the calculation unit 733 sets 0 to an offset value abnormality flag, which is used for determining whether the offset value used for correcting the color misregistration is within an appropriate range or not. At S2002, the calculation unit 733 starts driving the intermediate transfer belt 711. At S2003, the calculation unit 733 sets an image to the exposure control units 811Y, 811M, 811C, and 811K. At S2004, the calculation unit 733 decides whether preparations for the image formation have been completed or not. For example, the calculation unit 733 decides whether preparations of the paper discharge unit and so on have been completed or not based on a signal from the paper discharge unit. The calculation unit 733 advances to S2005 when the preparations for the image formation are completed. At S2005, the calculation unit 733 starts forming a Y toner image. Subsequently, at S2006, the calculation unit 733 detects the inclination of the intermediate transfer belt 711 by using the belt edge sensor 750 and the belt edge sensor 751, in order to calculate the offset value used for correcting the color misregistration of the M toner image. At S2007, the calculation unit 733 calculates the offset value Δd1*m* for correcting the color misregistration of the M toner image caused by the meandering of the intermediate transfer belt 711, based on the inclination thus detected. At S2008, the calculation unit 733 decides whether the offset value is greater than a threshold value or not. When the offset value is greater than the threshold value, the calculation unit 733 advances to S2010, and sets 1 to the abnormality flag, which indicates that the offset value is abnormal. If the offset value Δd1*m* for adjusting the write start position to decrease the misregistration in the main scanning direction is greater than the threshold value, it is likely that the intermediate transfer belt 711 is meandering widely. In such a situation, there is the possibility that the image quality becomes inconsistent. To perform control for resetting the position in which the intermediate transfer belt 711 becomes stable, 1 is set to the abnormality flag. Consequently, the movement of the belt is stabilized, and images with less color misregistration can be realized. Meanwhile, if the offset value is not greater than the threshold value, the calculation unit 733 advances to S2009, and sets the calculated offset value to the exposure control unit 811M. At S2011, the calculation unit 733 controls the exposure control unit 811M, thereby forming the M toner image.

At S2012, the calculation unit 733 detects the inclination of the intermediate transfer belt 711 by using the belt edge sensor 750 and the belt edge sensor 751, in order to calculate the offset value used for correcting the color misregistration of the C toner image. At S2013, the calculation unit 733 calculates the offset value Δd1*c* for correcting the misregistration of the write start position of the C toner image caused by the meandering of the intermediate transfer belt 711, based on the inclination thus detected. At S2014, the calculation unit 733 decides whether the offset value is greater than a threshold value or not. When the offset value is greater than the threshold value, the calculation unit 733 advances to S2016, and sets 1 to the abnormality flag, which indicates that the offset value is abnormal. Meanwhile, if the offset value is not greater than the threshold value, the calculation unit 733 advances to S2015, and sets the calculated offset value to the exposure control unit 811C. Subsequently, at S2017, the calculation unit 733 controls the exposure control unit 811C, thereby forming the C toner image.

At S2018, the calculation unit 733 detects the inclination of the intermediate transfer belt 711 by using the belt edge sensor 750 and the belt edge sensor 751, in order to calculate the offset value used for correcting the color misregistration of the K toner image. At S2019, the calculation unit 733 calculates the offset value Δd1*k* for correcting the misregistration of the write start position of the K toner image caused by the meandering of the intermediate transfer belt 711, based on the inclination thus detected. At S2020, the calculation unit 733 decides whether the offset value is greater than a threshold value or not. When the offset value is greater than the threshold value, the calculation unit 733 advances to S2022, and sets 1 to the abnormality flag, which indicates that the offset value is abnormal. Meanwhile, if the offset value is not greater than the threshold value, the calculation unit 733 advances to S2021, and sets the calculated offset value to the exposure control unit 811K. Subsequently, at S2023, the calculation unit 733 controls the exposure control unit 811K, thereby forming the K toner image.

At S2024, the calculation unit 733 decides whether there is any unformed image with respect to the job that is being executed, based on the job data. If there is an image to be formed next, the calculation unit 733 advances to S2003. If the formation of every image has been completed, the calculation unit 733 advances to S2025.

At S2025, the calculation unit 733 decides whether or not the abnormality flag is 1 and an automatic adjustment flag is 1. The automatic adjustment flag is a flag used for management as to whether to automatically control the position of the intermediate transfer belt 711 when the offset value is greater than the threshold value. When set to 1, the automatic adjustment flag indicates that the position of the intermediate transfer belt 711 is reset automatically, and when set to 0, the automatic adjustment flag indicates that the resetting of the position of the intermediate transfer belt 711 is not performed automatically. In other words, when the automatic adjustment flag is 0, the calculation unit 733 performs the resetting after an explicit instruction is input by the user. When the abnormality flag is not 1 or the automatic adjustment flag is not 1, the calculation unit 733 skips the resetting of the position of the intermediate transfer belt 711, and advances to S2027. On the other hand, when the abnormality flag is 1 and the automatic adjustment flag is 1, the calculation unit 733 advances to S2027. At S2027, the calculation unit 733 resets the position of the intermediate transfer belt 711 by driving the steering motor 205 so that the intermediate transfer belt 711 rotates stably. For example, the calculation unit 733 acquires an output value output by the belt edge sensor 751 while driving the intermediate transfer belt 711, and decides whether the intermediate transfer belt 711 is meandering or not. The calculation unit 733 changes the position of the intermediate transfer belt 711 by controlling the steering motor 205, and finds the position at which the meandering of the intermediate transfer belt 711 is minimized. Note that the calculation unit 733 determines the position that minimizes the meandering to be the central position of the belt deviation control. At S2027, the calculation unit 733 stops the belt drive motor 202 to stop the intermediate transfer belt 711.

Figure 9:
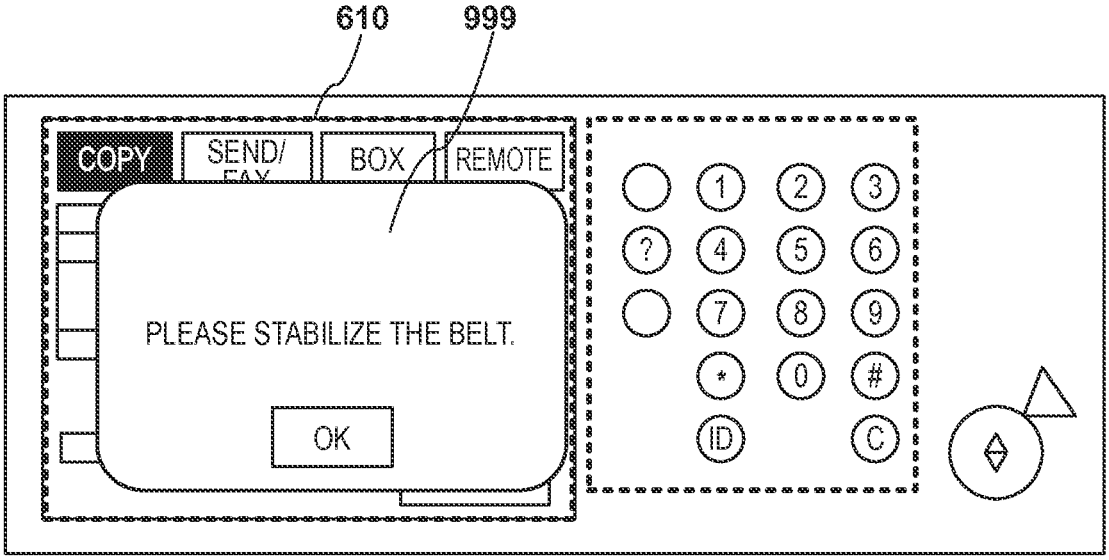
FIG. 9 is an example of a message prompting for belt stabilization.

At S2028, the calculation unit 733 decides whether or not the abnormality flag is 1 and an automatic adjustment flag is 0. If the abnormality flag is not 1, the calculation unit 733 ends this processing. When the abnormality flag is 1 and the automatic adjustment flag is 0, the calculation unit 733 advances to S2029. At S2029, the calculation unit 733 may display a message 999 as shown in FIG. 9 on a display unit 610 in order to prompt for execution of the control for resetting the position at which the intermediate transfer belt 711 becomes stable. When instructed by the user to start the control, the calculation unit 733 executes S2026.

As described above, according to the present embodiment, the first correction unit 781 detects the color misregistration caused by environmental change or a problem associated with the durability by using color patterns, and determines the offset values used for adjusting the write start timings of the images. Also, the second correction unit 782 determines the offset values (adjustment values) used for adjusting the write start timings of the images in order to correct the color misregistration caused by inclination of the intermediate transfer belt 711. Note that the offset values to be provided to the exposure control units may be modified according to the difference between the inclination at the time the first correction unit 781 determines the offset values and the inclination at the time the second correction unit 782 determines the offset values. In the present embodiment, it should be particularly noted that the reference color used for the determination of the offset values by the first correction unit 781 is different from the reference color used for the determination of the offset values by the second correction unit 782. This configuration allows for more accurate color registration adjustment not depending on the start timing of the image formation with respect to all of the plurality of colors. The reference color for the second correction unit 782 is, among the plurality of colors different from each other, the color that is used first for forming a toner image. In the present embodiment, the Y toner image is formed first, followed by the M, C, and K toner images in this order. Therefore, yellow is the color that is used first for forming a toner image. The reference color for the first correction unit 781 is, among the colors assigned to the plurality of image forming stations, the color of the second or later toner image in the order of formation, but is not the color of the last toner image in the order of formation. In the present embodiment, the Y toner image is formed first, followed by the M, C, and K toner images in this order. Therefore, magenta and cyan can be the reference color.

When the decision unit 783 decides that the offset values determined by the second correction unit 782 are greater than the predetermined threshold value (No at S2008, No at S2014, No at S2020), the second correction unit 782 does not necessarily set the offset values to the plurality of image forming stations. This is because if the offset values are too large, it means that the inclination of the intermediate transfer belt 711 is too large, and it is desired to adjust the inclination of the intermediate transfer belt 711. In other words, when the offset values determined by the second correction unit 782 are greater than the threshold value, the steering unit 784 drives the steering motor 205 so as to reduce the inclination of the intermediate transfer belt 711. As described for S2029, when the offset values determined by the second correction unit 782 are greater than the threshold values, a message prompting for adjustment of the inclination of the intermediate transfer belt 711 may be displayed on the display unit 610.

As described with reference to FIGS. 4A to 4C, the belt edge sensors 750 and 751 that perform measurement are an example of a plurality of sensors that detect the position of the side edge of the intermediate transfer belt 711. The inclination may be measured based on the position of the side edge of the intermediate transfer belt 711 detected by these sensors. Out of the belt edge sensors 750 and 751 that perform measurement, the first sensor may be disposed between the first image forming station and the second image forming station, and the second sensor may be disposed between the third image forming station and the fourth image forming station. The belt edge sensors 750 and 751 may have the LED 310 serving as a light-emitting element, the photosensors 305 and 306 serving as light-receiving elements, and flag 309 as well. The flag 309 is a shield member that is engaged with the side edge of the intermediate transfer belt 711 and reduces or increases the amount of light travelling from the light-emitting element to the light-receiving elements, by moving according to the position of the side edge of the intermediate transfer belt 711. Such a relatively simple configuration allows for more accurate detection of the inclination.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-107482, filed May. 23, 2014 which is hereby incorporated by reference herein in its entirety.

What is claimed is:

1. An image forming apparatus comprising:

a plurality of image forming units configured to form images each having a different color;

a transfer unit configured to perform primary transfer, to a transfer member, of images respectively generated by the plurality of image forming units;

a detection unit configured to detect a color pattern formed on the transfer member, the color pattern being used for detecting color misregistration;

a first determination unit configured to control the plurality of image forming units to form, on the transfer member, a plurality of color patterns, each having a different color, control the detection unit to detect the amount of color misregistration, related to a relative position of a color pattern having a first reference color among the plurality of color patterns and a color pattern having another color among the plurality of color patterns, and determine a first offset value for adjusting an image write start timing of the other color different from the first reference color based on the amount of color misregistration detected by the detection unit;

a measuring unit configured to measure the inclination of the transfer member; and a second determination unit configured to determine, based on the inclination measured by the measuring unit, a second offset value for adjusting the image write start timing of another color different from a second reference color, wherein the first reference color for the first determination unit is different from the second reference color for the second determination unit, wherein the other color different from the first reference color includes the second reference color, and wherein the other color different from the second reference color includes the first reference color.

2. The image forming apparatus of claim 1, wherein the second reference color for the second determination unit is, among a plurality of colors different from each other, the color that is used first for forming a toner image.

3. The image forming apparatus of claim 1, wherein the first reference color for the first determination unit is, among colors assigned to the plurality of image forming units, the color of the second or later toner image in the order of formation, and is not the color of the last toner image in the order of formation.

4. The image forming apparatus of claim 2, wherein the first reference color for the first determination unit is, among colors assigned to the plurality of image forming units, the color of the second or later toner image in the order of formation, and is not the color of the last toner image in the order of formation.

5. The image forming apparatus of claim 1, further comprising a correction unit configured to correct the image write start timing of the plurality of image forming units, based on the first offset value and the second offset value, wherein, in a case where the second offset value is greater than a predetermined threshold value, the correction unit does not perform correction based on the second offset value.

6. The image forming apparatus of claim 5, further comprising an adjusting unit configured to adjust the inclination of the transfer member, wherein the adjusting unit adjusts the inclination of the transfer member in a state where the second offset value is greater than the predetermined threshold value.

7. The image forming apparatus of claim 5, further comprising a display unit configured to display a message prompting for adjustment of the inclination of the transfer member in a case where the second offset value is greater than the predetermined threshold value.

8. The image forming apparatus of claim 1, wherein the transfer member is a belt, wherein the measuring unit includes a plurality of sensors, wherein the plurality of sensors is configured to detect a position of a side edge of the belt, and wherein the plurality of sensors measures the inclination of the belt based on the position of the side edge of the belt detected by the plurality of sensors.

9. The image forming apparatus of claim 8, wherein the plurality of image forming units includes a first image forming unit, a second image forming unit, a third image forming unit, and a fourth image forming unit, and among the plurality of sensors, a first sensor is disposed between the first image forming unit and the second image forming unit, and a second sensor is disposed between the third image forming unit and the fourth image forming unit.

10. The image forming apparatus of claim 8, wherein each of the plurality of sensors includes:

a light-emitting element;

a light-receiving element; and a shield member configured to engage with the side edge of the belt, and reduce or increase the amount of light travelling from the light-emitting element to the light-receiving element, by moving according to the position of the side edge of the belt.

11. An image forming apparatus comprising:

an image forming unit that has a first image forming part configured to form a first image of a first color based on a first condition, a second forming part configured to form a second image of a second color based on a second condition, and a third forming part configured to form a third image of a third color based on a third condition, the image forming unit being configured to form an image using the first image forming part, the second image forming part, and the third image forming part;

a transfer member to which the image that is formed by the image forming unit is transferred, the transfer member being configured to convey the image;

a controller configured to control the image forming unit to form pattern images including a first pattern image of the first color, a second pattern image of the second color, and a third pattern image of the third color;

a detection unit configured to detect the pattern images formed on the transfer member;

a determination unit configured to determine first information related to a relative position of the first pattern image and the second pattern image in a conveyance direction of the transfer member based on a detection result of the detection unit, and determine second information related to a relative position of the first pattern image and the third pattern image in the conveyance direction based on the detection result of the detection unit;

an obtaining unit configured obtain inclination information related to an inclination of the transfer member; and a generation unit configured to generate the first condition based on the inclination information obtained by the obtaining unit, generate the second condition based on the first information determined by the determination unit, and generate the third condition based on the inclination information obtained by the obtaining unit and the second information determined by the determination unit, wherein the first color is different from the second color and the third color, and wherein the second color is different from the third color.

12. The image forming apparatus according to claim 11, further comprising an adjusting unit configured to adjust the inclination of the transfer member such that the inclination of the transfer member is within a predetermined range.

13. The image forming apparatus according to claim 12, further comprising a prohibition unit configured to prohibit formation of the image in a case where the inclination is not within the predetermined range.

14. The image forming apparatus according to claim 12, further comprising a notification unit configured to notify that the inclination is not within the predetermined range.

15. The image forming apparatus according to claim 11, wherein the transfer member is a belt, wherein the obtaining unit includes a plurality of sensors, wherein the plurality of sensors is configured to detect a position of a side edge of the belt, and wherein the obtaining unit obtains the inclination information based on the position of the side edge of the belt measured by the plurality of sensors.

16. The image forming apparatus according to claim 15, wherein each of the plurality of sensors includes a light-emitting element and a light-receiving element, and wherein the each of the sensors senses the amount of light received by the light-receiving element depending on the position of the side edge of the belt.

* * * * *